United States Patent [19]

Van Kuren

[11] Patent Number: 4,648,652

[45] Date of Patent: Mar. 10, 1987

[54] COLLAPSIBLE PICNIC TABLE

[76] Inventor: Gerald B. Van Kuren, R.R. No. 2, Dunville, Ontario, Canada, N1A 2W2

[21] Appl. No.: 877,180

[22] Filed: Jun. 23, 1986

[30] Foreign Application Priority Data

Jul. 31, 1985 [CA] Canada ..... 487862

[51] Int. Cl.[4] ..... A47B 39/00

[52] U.S. Cl. ..... 297/159; 108/115

[58] Field of Search ..... 297/159, 157; 108/111, 108/115

[56] References Cited

U.S. PATENT DOCUMENTS 3,788,696 1/1974 Loewen ..... 297/159

3,797,884 3/1974 Gutierrez ..... 297/159

FOREIGN PATENT DOCUMENTS 665674 10/1965 Belgium ..... 297/159

323862 10/1957 Switzerland ..... 297/159

*Primary Examiner*—James T. McCall

*Attorney, Agent, or Firm*—Moss & Hammond

[57] ABSTRACT

A folding table includes a table top and two pairs of legs with each pair located adjacent a respective end of the top and pivotally connected thereto. Seats at each side of the table are supported on transverse bars carried by the pairs of legs. The seats have tracks extending longitudinally along the bottom of the seats. Slide members are mounted in the tracks and each pivotally connects a respective end of a transverse bar to its respective track. There are means for selectively maintaining each pair of legs in a standing position when the table is unfolded. In a preferred embodiment, the maintaining means include two brace members each hinged at one end thereof to a respective one of the transverse bars. The other end of each brace member is detachably connected to the underside of the table top.

10 Claims, 7 Drawing Figures

COLLAPSIBLE PICNIC TABLE

BACKGROUND OF THE INVENTION

This invention relates to folding tables and in particular such a table with seats provided on opposite sides thereof.

Various types of folding tables are well known and these include tables for indoor or outdoor use. Often tables are required for only short periods of time and it is advantageous to be able to store these tables in a folded condition when they are not required. In the case of an outdoor table, such as a picnic table, if the table can be folded, it can be placed in a sheltered location so that it is not subject to harmful weather conditions such as rain or snow.

A folding picnic type table with bench seats incorporated therein is taught in U.S. Pat. No. 2,583,247 issued Jan. 22, 1952 to S. Aja et al. In this table a pair of legs are connected by hinges to each end of the table top and can be folded upwardly under the top. Each pair is connected together by a transverse bar and seats at each side of the table are supported on the two transverse bars. The seats have slots in which the bars are slidable during folding movement of the legs. Pivotable locking bars located in these slots are used to hold the legs in the open position.

Another form of collapsible table is that shown in U.S. Pat. No. 4,060,275 issued Nov. 29, 1977 to James Hansen. In this patent, the pair of legs at each end are hinged to the bottom of the table and are connected together by a cross member. There is also a centre brace member hinged to the bottom of the centre board of the table top. When the table is in the open position, the ends of the centre brace press against the cross braces that connect the legs at each end.

The present invention provides a folding table that can be constructed with relative ease and using inexpensive components. The table can be folded for storage in a simple manner that requires little, if any, prior instruction.

SUMMARY OF THE INVENTION

According to the present invention, a folding table comprises a table top and two pairs of legs with each pair located adjacent a respective end of the top and pivotally connected thereto. A transverse bar is carried by each pair of legs and seats at each side of the table are supported on these transverse bars. The seats have tracks extending longitudinally along the bottom thereof and slide members are mounted in these tracks. Each slide member pivotally connects a respective end of the transverse bar to its respective track. Means are provided for selectively maintaining each pair of legs in a standing position when the table is unfolded.

In a preferred embodiment, the maintaining means include two brace members each hinged at one end thereof to a respective one of the transverse bars and detachable connecting means for attaching the other end of each brace member to the underside of the top. The maintaining means can also comprise means for clamping each slide member to its respective track to prevent movement of the slide member along its track.

BRIEF DESCRIPTION OF THE DRAWINGS

Further features and advantages will become apparent from the following detailed description when taken in conjunction with the accompanying drawings wherein.

DETAILED DESCRIPTION OF PREFERRED EMBODIMENT

Figure 1:
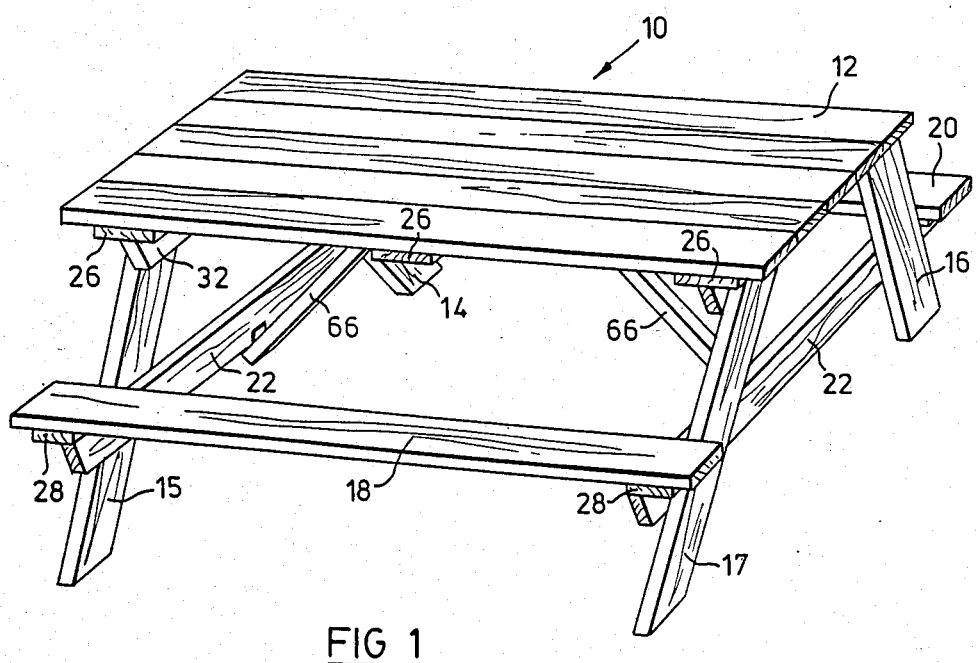
FIG. 1 is a perspective view showing a table constructed in accordance with the invention.

The principal components of the folding table 10 include a table top 12, two pairs of legs 14 to 17 and bench type seats 18 and 20. Each pair of legs is located adjacent a respective end of the table top and is pivotally connected thereto in a manner explained hereinafter. A transverse bar 22 is carried by and connects each pair of legs. The bench seats 18, 20 are supported on these transverse bars.

In the illustrated preferred embodiment, the table top 10 is constructed from five wooden planks which can measure 6′ long by 5½″ wide by 1½″ thick. These planks are connected together by three cross pieces 26, two of which may be located at the ends of the table and the third at the centre. In one embodiment the cross pieces measure 27″ long by 5½″ wide by ¾″ thick. The bench members 18 and 20 can also be made from wooden planks measuring 6′ long by 7½″ wide by 1½″ thick. Located at each end of the bench is an end piece 28 that can measure 7½″ by 3½″. These end pieces support connecting hinges 80 for securing the legs in the upright position in a manner to be described.

Figure 3:
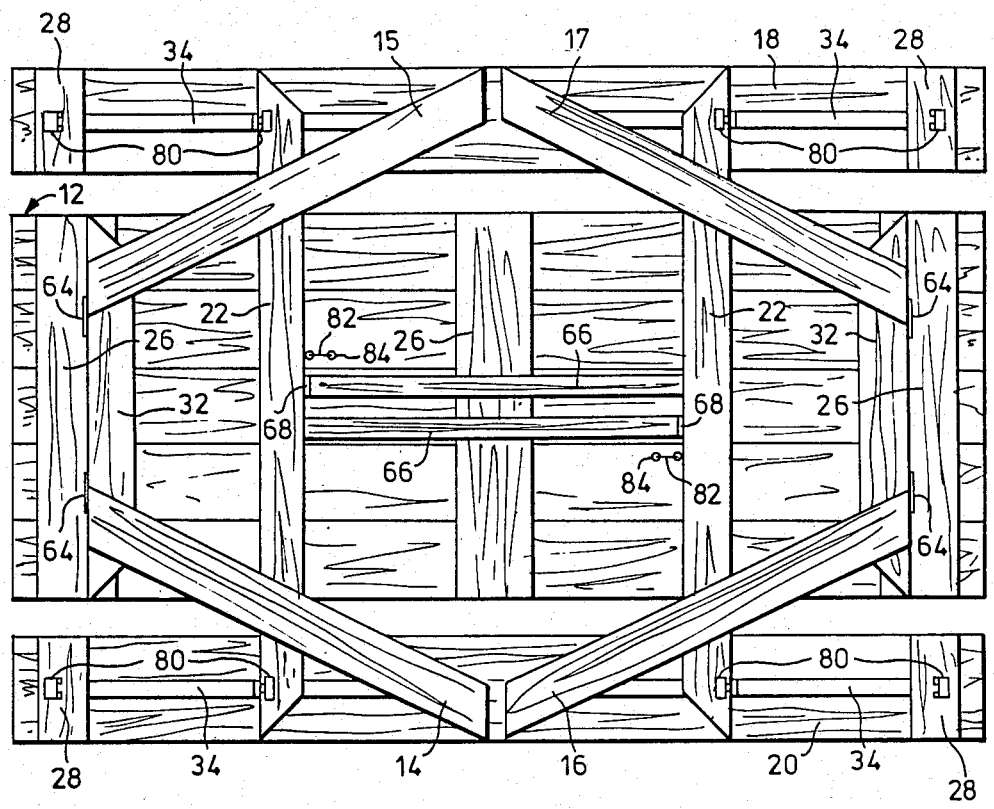
FIG. 3 is a bottom view showing the table in a collapsed or folded position.

The tops of the legs are rigidly connected to one another by cross bars 32 which can be cut at an angle at each end as shown in FIG. 3. In one embodiment the cross bars 32 measure 27″ long by 3½″ wide and they are attached to the legs with either wood screws or nails.

Figure 5:
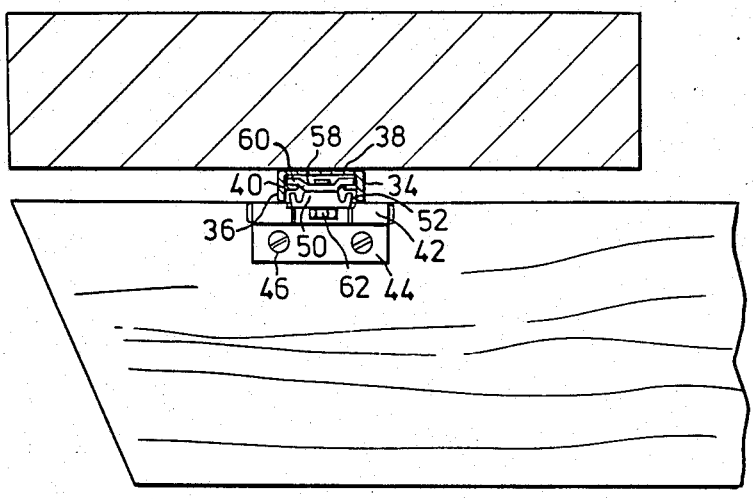
FIG. 5 is a sectional detail taken along line V—V of FIG. 2 showing the connection to the metal track located under each seat.
Figure 6:
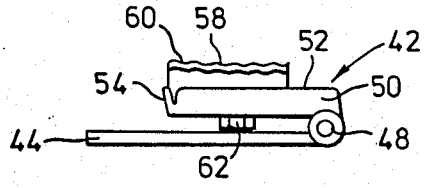
FIG. 6 is a side detail showing a preferred form of slide member.

Metal tracks are rigidly connected along the bottom of the seat members 18, 20. In fact, there is one track 34 for each of the four legs. The cross section of each track 34 can be seen in FIG. 5. The preferred track is a channel-type member having two legs 36 connected together by a web 38. Holes (not shown) are provided in web 38 so that the track can be connected by screws to the bottom of the bench seat 18 or 20. Each leg 36 has an inwardly extending flange 40 formed thereon. Mounted in each track 34 is a slide member 42. The slide member has a hinge flap 44 having holes therein for passage of screws 46. The flap 44 is connected to the side of a transverse bar 22. The flap 44 is connected by a hinge pin 48 to a main section 50 adapted to fit in the track 34. In one embodiment the section 50 has a generally U-shaped cross-section with legs 52 that extend in the direction of the adjacent bench seat. The section 50 can be provided with a rigid end flap 54 if desired. Connected by a bolt to the main section 50 is a track connecting section 58 having two outwardly extending legs 60. These legs extend under respective flanges 40 of the track. The connecting bolt 62 extends through a threaded hole in the centre of the section 58. By tightening the bolt 62, the section 58 is drawn towards the main section 50 and this eventually results in the slide member being clamped to the track, thus preventing movement of the slide member along the track. When each pair of legs has been brought to the unfolded or standing position shown in FIGS. 1 and 2, the pair of legs can be maintained in this position by tightening the bolts 62.

Figure 7:
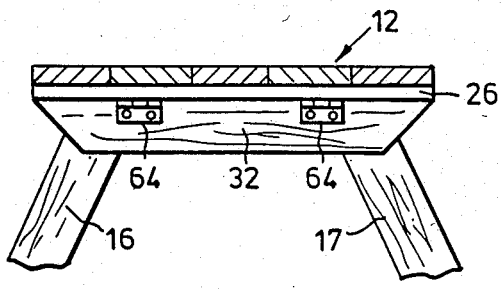
FIG. 7 is a sectional elevation taken along the line VII—VII of FIG. 2.

FIG. 7 indicates the manner in which each crossbar 32 is pivotally connected to a cross piece 26 at the end of the table. In the preferred embodiment shown, there are two butt hinges 64 which can be 3" hinges. One flap of each hinge is connected to the inside surface of the crossbar 32 while the other flap is connected to the bottom of cross piece 26. Thus each pair of legs can be folded inwardly to the position shown in FIGS. 3 and 4. When this folding occurs, each slide member 42 moves along its respective track 34 to a position closer to the longitudinal centre of the table.

In order to increase the rigidity of the table and to provide a further means for selectively maintaining each pair of legs in a standing position when the table is unfolded, there are preferably provided two brace members 66. Each brace member is hinged at its bottom end to a respective one of the transverse bars 22. The hinge 68 can comprise a 1½" back flap hinge, one flap of which is connected to the inside surface of the transverse bar 22 and the other flap of which is connected to a longitudinal side of the brace member which, in a preferred embodiment, has a length of 27" and a cross sectional dimension of 1½" in each direction. The top end of each brace member is angled at 70 so that, when the table is erect, the top end is parallel to and against the underside of the table top. A strap hinge 72 with a removable pin detachably connects the top end of each brace member to the underside of the table top. In order to fold the legs to the position shown in FIG. 3, it is necessary to remove the pin from each of the hinges 72. Preferably the position of each brace member 66 is offset from the transverse centre of the table as shown in FIG. 3 so that they do not interfere with one another when the legs are folded.

To increase the rigidity of the erect table, optional hinges 80 can be used to connect each end piece 28 of the bench seat to the adjacent transverse bar 22. One flap of the hinge 80 is attached by screws to the bottom surface of the end piece 28 while the other flap is attached to the outside of the bar 22. The hinge 80 can be a 3" butt hinge having an easily removable pin.

Figure 2:
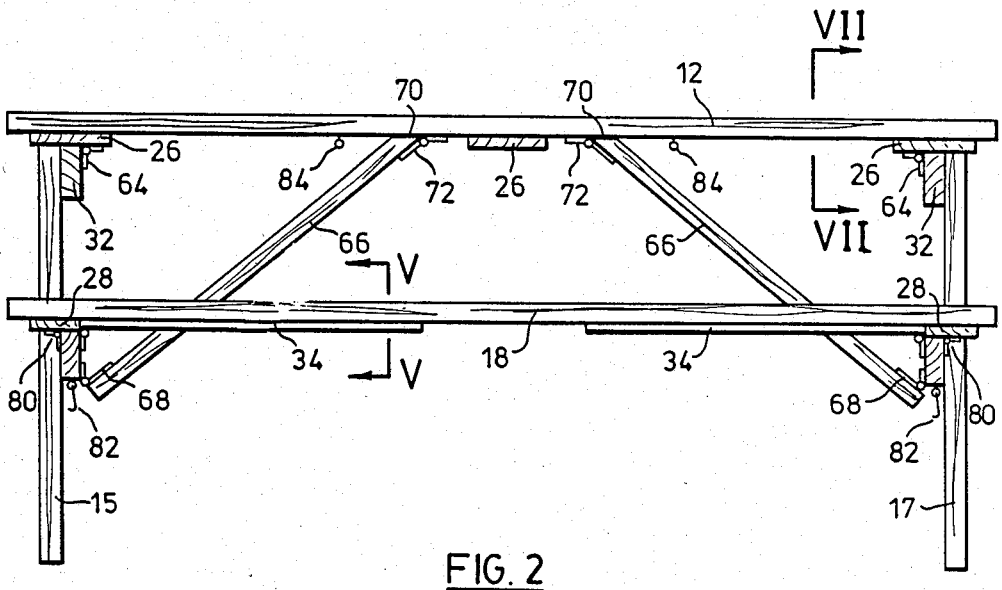
FIG. 2 is a side elevation showing the table of FIG. 1 in the erect position.
Figure 4:
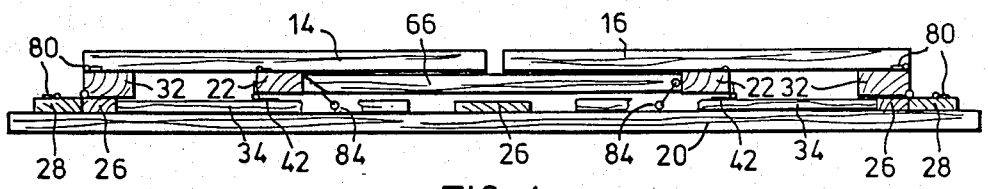
FIG. 4 is a side view of the folded table of FIG. 3.

In order to provide a means for maintaining the legs in the folded position shown in FIGS. 3 and 4, a gate hook connector can be provided for each pair of legs. The gate hook 82 is preferably connected to the underside of the transverse bar 22 as shown in FIG. 2. Preferably it is a few inches offset from the centre of the transverse bar so that the brace member 66 will not interfere with its use. An eye 84 is screwed into the bottom of the table top so that it can engage the hook when the table is folded.

It will be obvious to those skilled in this art that various modifications and changes could be made to the table as decribed without departing from the spirit and scope of this invention. Accordingly, all such modifications and changes as fall within the scope of the appended claims are intended to be part of this invention.

I claim:

1. A folding table comprising a table top, two pairs of legs with each pair located adjacent a respective end of said top and pivotally connected thereto, a transverse bar carried by each pair of legs, seats at each side of said table supported on the transverse bars, said seats having tracks extending longitudinally along the bottom of the seats, slide members mounted in said tracks, each pivotally connecting a respective end of a transverse bar to its respective track, and means for selectively maintaining each pair of legs in a standing position when the table is unfolded.

2. A folding table according to claim 1 wherein said maintaining means include two brace members each hinged at one end thereof to a respective one of the transverse bars and detachable connecting means for attaching the other end of each brace member to the underside of said top.

3. A folding table according to claim 1 wherein said maintaining means include means for clamping each slide member to its respective track to prevent movement of the slide member along its track.

4. A folding table according to claim 2 wherein said maintaining means include means for claimping each slide member to its respective track to prevent movement of the slide member along its track.

5. A folding table according to claim 1 wherein the legs of each pair are connected together at their top ends by a crossbar and each crossbar is connected by hinge means to said table top.

6. A folding table according to claim 1 including hook means for holding each pair of legs in a folded position adjacent the underside of the table top.

7. A folding table according to claim 2 including hook means for holding each pair of legs in a folded position adjacent the underside of the table top.

8. A folding table according to claim 2 wherein said detachable connecting means comprises a hinge-type connector for each brace member.

9. A folding table according to claim 1 wherein each track comprises a channel-type member having two legs connected by a web and each leg has an inwardly extending flange formed thereon.

10. A folding table according to claim 7 wherein each slide member includes a main section adapted to fit in the track between the legs thereof and two outwardly extending legs connected to said main section, each leg extending under a respective flange of said track.

* * * * *